US006302214B1

(12) United States Patent
Carmichael et al.

(10) Patent No.: US 6,302,214 B1
(45) Date of Patent: Oct. 16, 2001

(54) APPARATUS AND METHOD FOR INFLATING PACKERS IN A DRILLING WELL

(75) Inventors: Mark Carmichael, Aberdeenshire; Paul Howlett, Aberdeen, both of (GB)

(73) Assignee: Specialised Petroleum Services Limited, Aberdeenshire (GB)

( * ) Notice: Subject to any disclaimer, the term of this patent is extended or adjusted under 35 U.S.C. 154(b) by 0 days.

(21) Appl. No.: 09/367,916

(22) PCT Filed: Nov. 30, 1999

(86) PCT No.: PCT/GB98/03795

§ 371 Date: Nov. 17, 1999

§ 102(e) Date: Nov. 17, 1999

(87) PCT Pub. No.: WO99/32756

PCT Pub. Date: Jul. 1, 1995

(30) Foreign Application Priority Data

| | | |
|---|---|---|
| Dec. 22, 1997 | (GB) | 9726980 |
| Feb. 21, 1998 | (GB) | 9801225 |
| Feb. 26, 1998 | (GB) | 9803915 |
| Mar. 3, 1998 | (GB) | 9804339 |
| Jun. 17, 1998 | (GB) | 9812988 |

(51) Int. Cl.[7] ..... E21B 33/127

(52) U.S. Cl. ..... 166/373; 166/187; 166/285

(58) Field of Search ..... 166/373, 250.09, 166/285, 187, 195, 281, 127, 129

(56) References Cited

U.S. PATENT DOCUMENTS

| | | | | |
|---|---|---|---|---|
| 1,342,927 | * | 6/1920 | Ruthven | 166/187 |
| 1,944,442 | * | 1/1934 | Manning | 166/187 |
| 2,781,852 | * | 2/1957 | Rumble | 166/187 |
| 2,978,029 | * | 4/1961 | O'Reilly et al. | 166/197 |
| 3,301,329 | * | 1/1967 | Martin | 166/187 |
| 3,578,079 | * | 5/1971 | Alexander | 166/187 |
| 3,578,083 | * | 5/1971 | Anderson | 166/285 |

* cited by examiner

*Primary Examiner*—Frank S. Tsay
(74) *Attorney, Agent, or Firm*—Fleshner & Kim, LLP

(57) ABSTRACT

Apparatus and method is disclosed for setting inflatable packers in a well bore which includes the transporting of settable fluid from the surface with a work string or liner as it is run in the well. The invention therefore negates the requirement of having to pump cement or the like to precise locations down hole to the vicinity of the packers to be set.

28 Claims, 6 Drawing Sheets

APPARATUS AND METHOD FOR INFLATING PACKERS IN A DRILLING WELL

BACKGROUND OF THE INVENTION

This invention is in the field of oil and gas drilling and has a common, although not exclusive, application in off shore drilling where horizontal wells are involved.

It is recognised in the art of oil and gas drilling that it is, at times, desirable to provide annular isolation in a well liner using formation packers in lieu of conventional annular cementing. This allows for improved well management, and more specifically, the creation of zones to enable:

the separation of phases of oil, gas or water, in a well;

the injection of chemicals, cement or the like at a particular predetermined location in the well; and or the monitoring or analysis of flow or other conditions at a particular location in the well.

Typically, packers used for the creation of such annular isolation or zones are of the inflatable type, adapted to be filled with cement or some other settable composition such as resin. Occasionally, the packers may be inflated with drilling mud, particularly if their use is only needed for a short time. The present invention results from a desire to provide improved and more reliable means of inflating these packers.

Inflatable packers may also be used in certain situations on the outside of the liner. The present invention also encompasses the inflation of packers in such location. Indeed, the invention may be applied to any situation or location where down hole packers require to be inflated.

Where cement or other settable fluid has been used in the past, the task of inflating a packer required pumping a relatively small amount of the settable fluid from the surface to a remote location where a packer is to be set, potentially tens of thousands of feet from the surface. The cement or other composition has been required to be pumped to the precise location of the packer or each packer to be inflated. This involved several procedural steps, with the success of the entire procedure being dependent on each step being performed successfully In many cases, it is important also for the cement or other settable composition to be delivered to the packer without having been contaminated by other fluids, such as mud or the like. Again this has proved difficult to achieve in the past, leading to eventual packer failure as a result of it being inflated with cement or other composition of low integrity.

SUMMARY OF THE INVENTION

An object of the present invention is to provide an improved method of setting and inflating packers in oil or gas wells. A further and related object of the present invention is to improve the reliability of delivering the cement or other setting fluid to the packers. A yet further object of the present invention is to improve the quality of the settable fluid (or reduce the level of contaminants therein) that is delivered to the inflatable packers. The invention also provides apparatus and method for improving the efficiency of setting several packers, and indeed doing so simultaneously.

According to a first aspect of the present invention there is provided a method for inflating a packer in a well bore or down hole environment, the method comprising the steps of:

a) filling a compartment in or associated with a work string or liner string with cement or other settable fluid at or near the surface of the well;

b) thereafter transporting the cement or settable fluid down the well bore in conjunction with the work string or liner string; and c) injecting the cement or other settable fluid into an inflatable packer.

As it might otherwise be difficult to inject the cement or other settable fluid into the inflatable packer without first injecting at least some mud or other fluid, the method may also include the step of injecting an associated secondary packer substantially with mud or drilling fluid until the cement or settable fluid is presented for injection prior to step c) above, the additional packer typically being positioned adjacent to the first inflatable packer.

The method may be used for providing an annular seal or barrier in a liner. Alternatively, the method may be used in the task of hanging a liner or for packing the outside of a liner.

It may be necessary to pick up the string to align a port in the string with a port or the like in a said packer to allow Step c) above to be performed. This, together with Step c) above may be repeated for additional inflatable packers.

Where there are a plurality of inflatable packers, the packers may be adapted for setting at different pressures. More particularly, the method may include inflating a first packer at a first setting pressure, picking up or relocating the string to align a port in the string with an inlet in a second packer and then inflating said second packer at a second setting pressure, the second setting pressure being higher than the first setting pressure. Additional packers may be successively inflated each having successively higher setting pressures. This has the advantage that in the event of any one inflatable packer failing, it may be bled off back to a negligible pressure without affecting the ability to inflate subsequent packers.

The work string may be an inner string that supports the cement or other fluid between a plug located at the lower end of the inner string and a barrier further up the inner string. The work string may also be one of dual strings, the other of the dual strings enabling circulation.

The method may further include the step of performing a pressure test to test the integrity of the inner string.

According to a second aspect of the invention, there is provided a method of setting a plurality of inflatable packers comprising the steps of:

locating dedicated inflation tools on a string prior to running the string, the tools being separated by a distance corresponding to the distance separating the packers to be set;

subsequently running the string, thereby transporting the inflation tools to the vicinity of the packers;

aligning the inflation tools with the packers; and thereafter injecting fluid into the packers simultaneously.

The fluid may be cement, a settable resin, drilling mud or any other fluid known in the art. Preferably the fluid is cement that has been prior prepared under controlled conditions on-shore, the cement having been mixed with an additive or catalyst prior to use and typically off-shore, wherein the additive or catalyst is adapted to cause the setting of the cement at a known or predetermined rate.

The string may be a work string, drill string or liner string. The string may also be one of dual strings, the other of the dual strings enabling circulation.

According to a third aspect of the present invention there is provided a work string or liner for use in a well bore, the work string or liner comprising means for supporting cement or other fluid while being run in the well bore, the cement or other settable resin being suitable for inflating one or more inflatable packers in the well bore.

The work string may be associated with locating means such as collets adapted to locate the string at an appropriate position for the inflation of a respective packer.

The work string may be an inner string and may include a plug located at its lower end. A barrier may also be provided in the work string above the cement or other fluid to prevent or mitigate the influx of mud or other contaminants into the cement phase. The barrier may be a foam ball.

The work string may include a bypass means to enable circulation of fluid through the work string, the fluid being able to bypass the cement or other settable fluid and plug. Alternatively, the work string may be one of dual strings running parallel in the well, wherein the other of the dual strings is a circulation string. The circulation string may be associated with means for opening and closing a circulation path therein. For example, the circulation string may have a seat for landing a ball or dart.

According to a fourth aspect of the present invention, there is provided a work string supporting a plurality of inflation tools for inflating packers on a liner or the like, wherein the inflation tools are spaced on the work string by distances which correspond to the spacing between the packers.

BRIEF DESCRIPTION OF THE DRAWINGS

In order to provide a better understanding of the invention, example embodiments and methodology for using same will now be described with reference to the accompanying Figures, in which.

DETAILED DESCRIPTION OF THE PREFERRED EMBODIMENTS

Figure 1A:
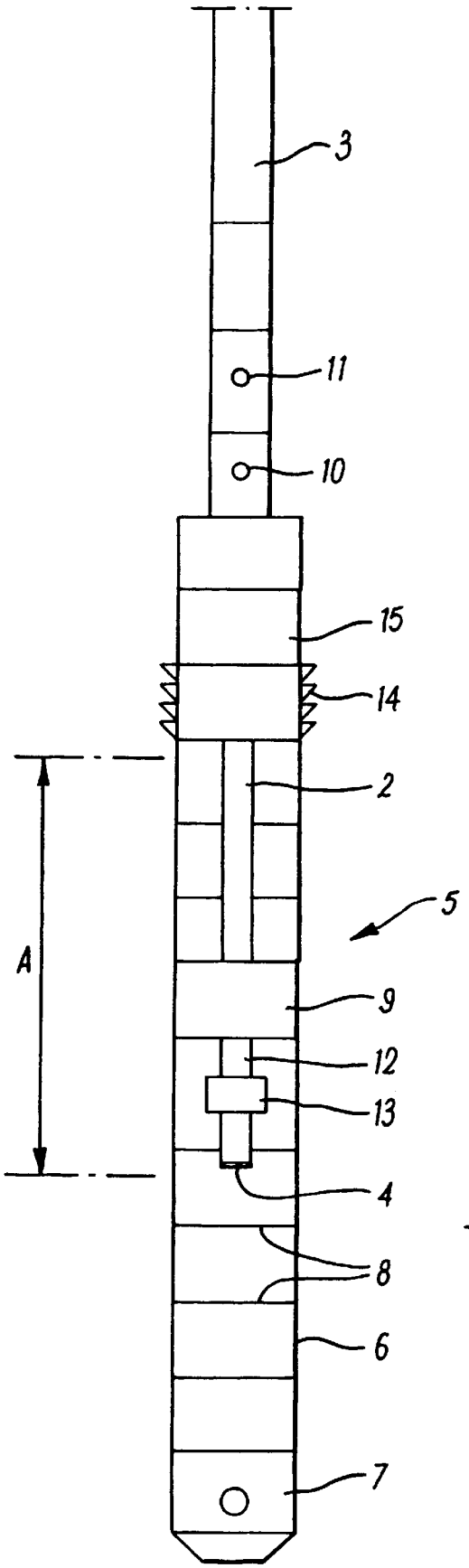
FIG. 1*a* shows an inner string suspended from a liner running tool in accordance with the invention.
Figure 1B:
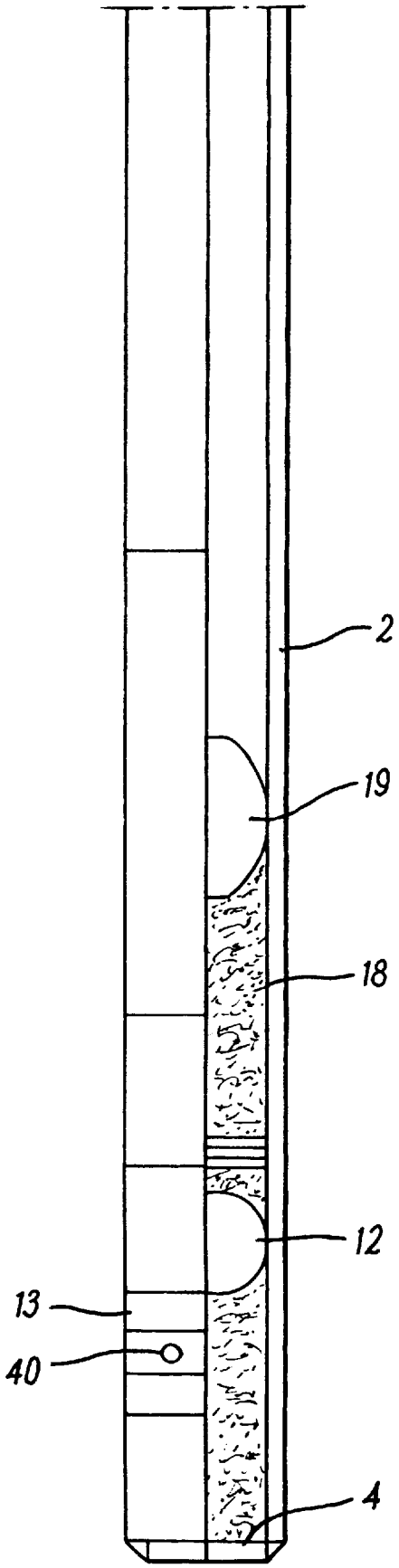
FIG. 1*b* shows in greater detail the inner string and related components in the length A marked on FIG. 1*a;*

Referring firstly to FIG. 1, an inner string 2 is suspended from a drill pipe or liner running string 3. The inner string 2 is plugged at its lower end by a blank plug 4. In the example, the plug 4 is of aluminium construction, but may be of any suitable material and type known in the art.

The inner string 2 is shown positioned within an outer string 5 that includes a liner 6, float shoe 7 and several screens 8. An inflatable casing packer 9 is located within the liner 6 and is adapted to provide a means for creating an annular seal or barrier. This is done by inflating the packer 9 with cement; the cement being supplied within the inner string 2 above the blank plug 4. A foam ball 19 or other barrier may be located above the cement slurry 18 to prevent the cement 18 from being contaminated with mud or other fluids.

It may be noted that in the embodiment of FIG. 1, circulation of fluid through the inner string 2 is prevented by the inclusion of the cement slurry 18 and the plug 4 within the string 2. Accordingly, a port 10 maintained generally in an open position is provided in the drill pipe 3 to allow for circulation at the top of the liner 6. A second port 11, maintained usually in a closed position, is also provided and adapted to be opened by conventional means such as at the end of the drilling procedure when the tool is to be withdrawn from the well bore.

The inner string 2 also incorporates a check valve 12 which provides a safety means to ensure that the cement is not able to flow out the lower end of the drill string 3, even in the event of the plug 4 failing or being displaced.

In the event that several packers are required, several check valves 12 may be incorporated.

A packer inflation tool 13 is provided on the inner string 2 and has a port 40 to provide a communication channel of the cement from within the inner string 2 to the packer 9.

In use, the drill string 3, with the outer string 5 and inner string 2 attached, is run in the well bore. The inner string 2 is run with ample cement positioned between a foam ball or barrier 19 and the check valve 12. Once the float shoe 7 has reached its intended location, usually near the extremity of the well bore, the port 10 is closed and by means of pressurising or other known methods the liner is hung by the liner hanger 14 and the liner top packer 15 is set.

Thereafter, the inner string 2 is picked up to position the packer inflation tool 13 at the packer 9. Notably, the port 40 on the inflation tool 13 is correctly located to allow for the conveyance of cement from the inner string 2 into the packer 9.

In practice, there may be a distance of up to a few meters between the inlet port of the packer and an outlet port, 40 on the inflation tool 13 or inner string 2. Accordingly, care should be taken to ensure th cement or other suitable fluid flowing out of the inner string 2 is not undesirably contaminated by drilling mud or the like within the liner 6.

Figure 4:
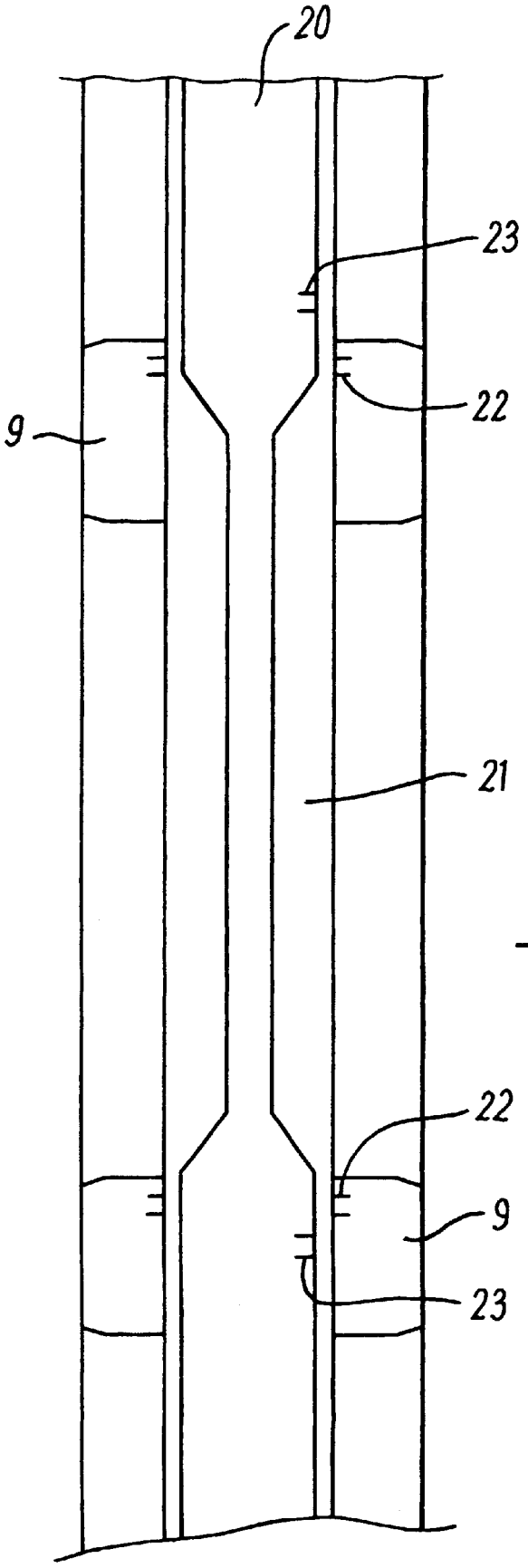
FIG. 4 shows an alternative embodiment with multiple packers.

In the embodiment illustrated in FIG. 4, means are provided to mitigate the contamination of the cement. These means include a reduction in the diameter of the inner string or mandrel 2 in the area between two inflatable packers 9. This area, reference 21 in the drawing, provides a volume in which mud or fluid may be compressed. More specifically, the area 21 maintains the mud or other contaminants away from the cement or other fluid as it travels from the outlet port 23 in the inner string to the inlet port 22 in a respective packer 9.

In a yet further example, not specifically illustrated, seals may be provided on either side of each inflatable packer. The process of picking up the inner string could activate or engage the seals depending on the particular type of seal used. The present invention is not limited to any particular type of seal or even the use of a seal in the manner described.

For example, seals having fixed outside diameters, such as O-rings or rubber rings could be located in seats on either side of a respective packer; the rings sealingly engaging the inner string and enabling the "clean" communication of settable fluid out of the inner string and into an adjacent packer. Alternatively, compression or tension activated seals may be employed that are activated by the picking up or slacking off of weight of the string. A yet further alternative may be found in the use of inflatable seals, which may be activated by the process of pressuring up down hole.

Other means may be incorporated to mitigate the contamination of the settable fluid. For example, a plurality of sprung loaded balls could be located at respective parts in the inner string, whereby when the balls are in their normal position, they close the ports and prevent the flow of cement out of the inner string. However, when the balls are in the vicinity of a packer inlet port, they are caused to open or dislodge by a reduced internal diameter of the liner 6 or sealed bore in that vicinity. Similar apparatus may be used instead of the balls, including dogs or the like.

In a yet alternative arrangement, a secondary or sacrificial packer may be provided in association with each main inflation packer, the secondary packer or packers being used to receive and store any drilling mud that might otherwise be injected into the main packers intended to contain only settable fluid. Typically these secondary packers would be located in juxtaposition with the main or primary packers and consume the drilling fluid that existed between the settable fluid phase and the primary packer.

Such an arrangement not only serves to solve what might otherwise be problematic but provides an additional benefit in the provision of an extra packer or packers with better sealing qualities—by reason of the more dynamic nature of mud or fluid—than usually characteristic of packers inflated with cement or the like.

Care may also be taken to use a high quality cement or other settable fluid at surface. For example, pre-prepared cement is now or will soon be available in barrels; the cement having been mixed under superior conditions on-shore than that which is typically available on site, particularly on an off-shore oil rig. A catalyst may be added to the pre-mixed cement just prior to it being inserted in the work string, giving an operator an accurate knowledge of setting times and how the cement will behave.

Returning to the manner of use of the drill string shown in FIG. 1, the string is pressurised further to open the check valve 12 and allow the cement to flow down the inner string 2 and out the inflation tool 13 into the packer 9.

In the event that there are a plurality of packers 9, the procedure may be repeated such that the inner string is repositioned after each packer is set to position the inflation tool 13 at each packer before pressuring up. In such event, the packers may be arranged to have progressively higher setting pressures, such that in the event that any one of the packers fails, it may be bled off back to zero, without preventing the ability to inflate subsequent packers. For example, a first packer may be set at 1,000 psi, a second at 1,400 psi and so on.

Alternatively, and in accordance with the second and fourth aspects, a dedicated and carefully positioned inflation tool may be provided on the inner string 2 for each respective inflatable packer. This would negate the requirement of multiple locating of the inner string 2 and single tool 13, and moreover allow for simultaneous setting of multiple inflatable packers. Moreover, it should be noted that the simultaneous inflation of multiple packers is not dependent upon the type of fluid used to fill the packers.

Figure 2:
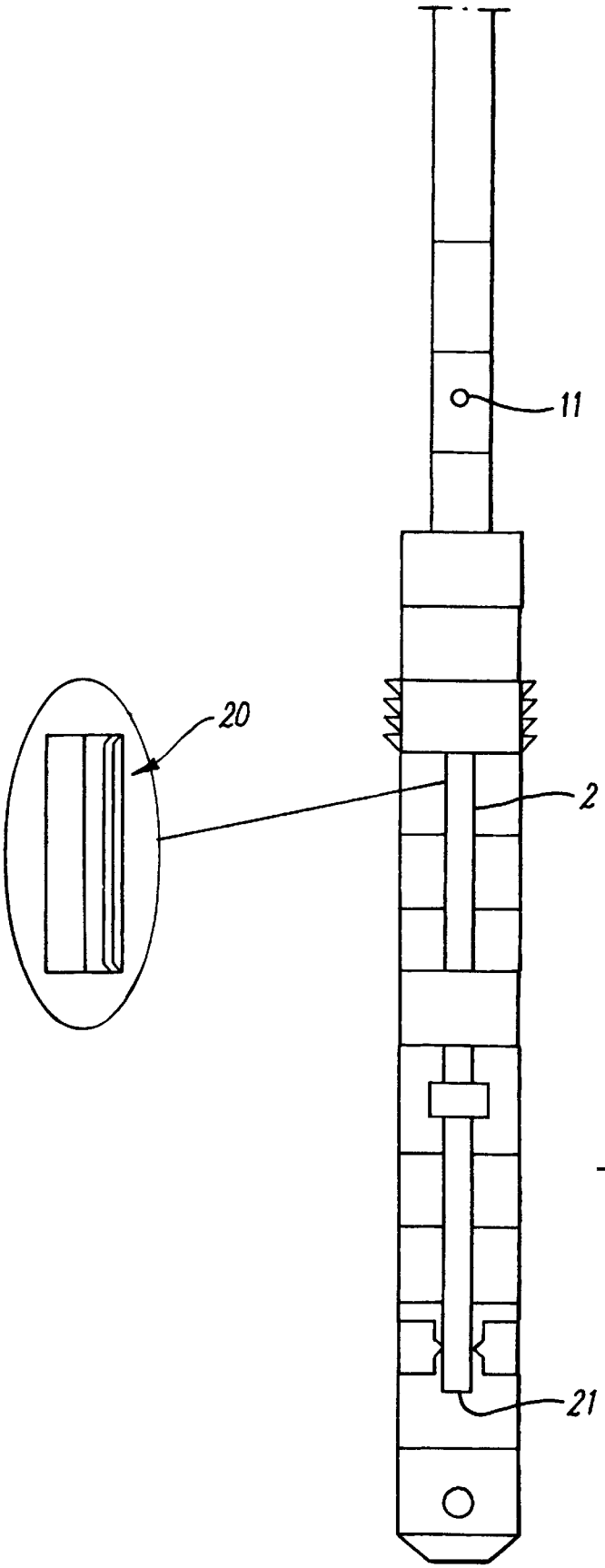
FIG. 2 shows a second inner string associated with a by-pass tool.

Turning now to FIG. 2, similar apparatus is shown to that which is illustrated in FIG. 1. However, the inner string 2 includes a bypass means by virtue of the sub 20. The bypass sub 20 creates a circulation path that bypasses the cement slurry, check valve and lower plug, allowing for circulation of fluid out of an outlet 21 at the bottom of the inner string 2.

As circulation through the inner string 2 is maintained, if desired, the port 10 shown in FIG. 1 is omitted.

In a yet further embodiment, not illustrated in this specification, the cement or other settable fluid may be supported on the inner string 2 in a manner that does not block or completely block the passage through the internal bore of the inner string 2. For example, the cement could be supported on the exterior surface of the inner string 2; there being suitable means for enabling passage of the cement into the inflatable packer or packers when desired.

In the invention herein, it is however recognised that circulation below the liner top offers little advantage, particularly as flow rates tend to be too insignificant to serve any real purpose.

Figure 3:
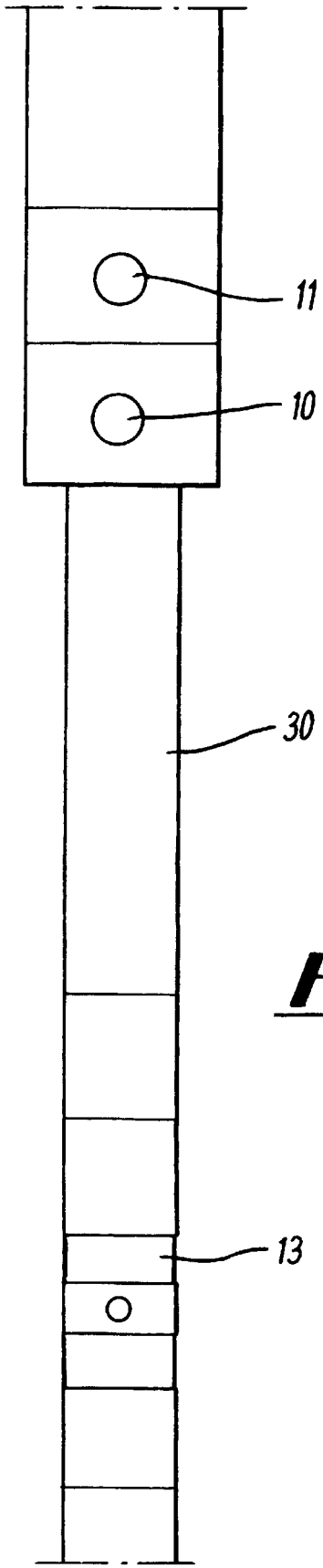
FIG. 3 shows a work string that may be used in accordance with the invention.

It should also be understood that the invention is not limited to applications where the inner string 2 is run simultaneously with an outer string 5, as shown in FIGS. 1 and 2. In FIG. 3 there is shown a work string 30 that may be run in and subsequent to a liner (not shown). The work string may support a settable resin suitable for inflating and setting a packer, and one or more packer inflation tools 13.

Figure 5:
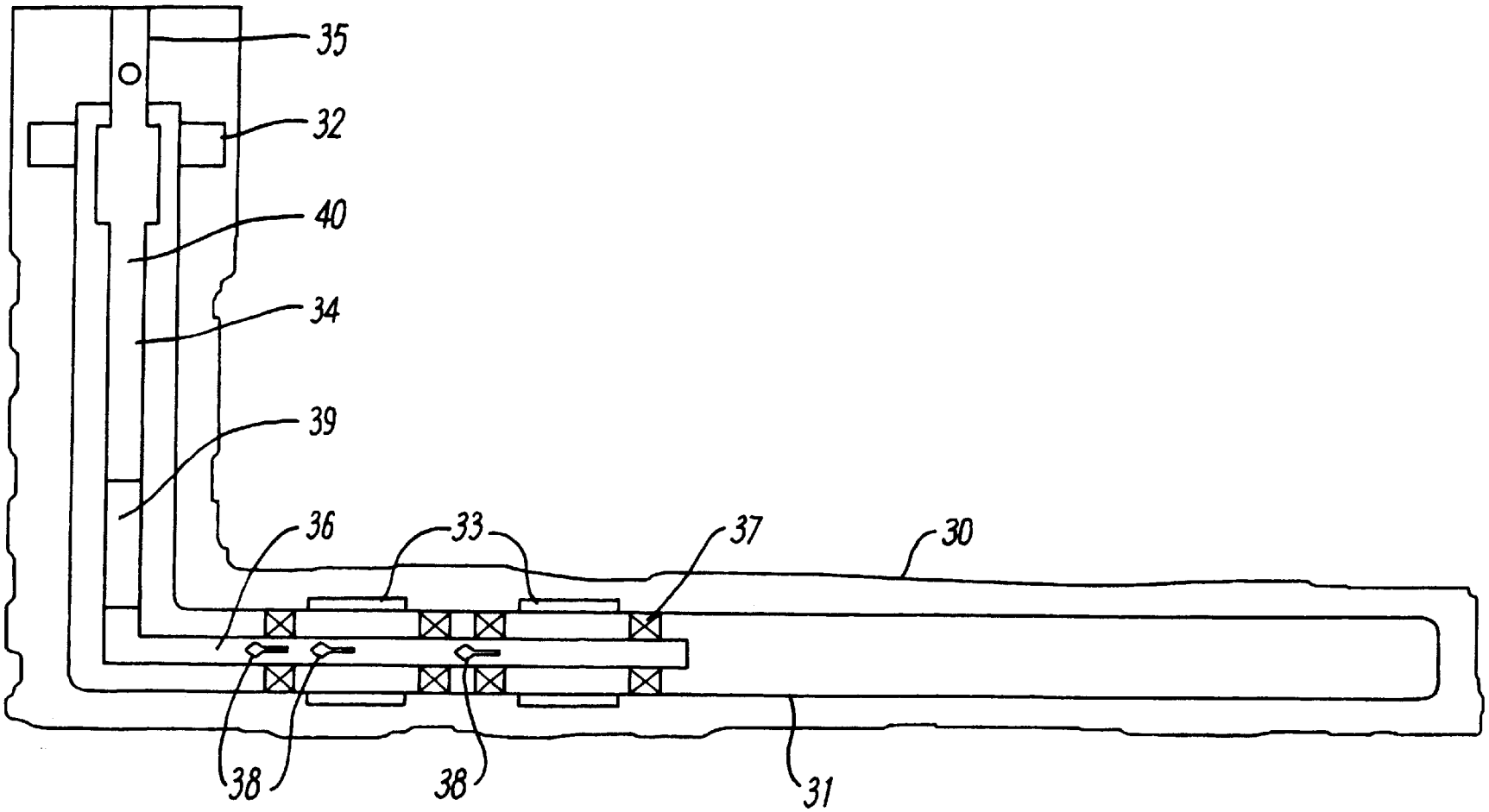
FIG. 5 is a schematic drawing illustrating example apparatus of the invention run in a well bore.

FIG. 5 illustrates by way of schematic much of the apparatus discussed above. A well bore 30 has a vertical aspect and a horizontal aspect. A liner 31 is hung in the well 30 with the aid of liner hangers 32. Inflatable packers 33 are positioned on the outside of the liner 31.

An inner string 34 is suspended from drill pipe 35 The inner string 34 is run while supporting a phase of cement 36, packer inflation tools 37 and check valves 38. A plug (not shown) is located at the bottom of the inner string 34 to prevent the passage of the cement 36 out of the bottom end of the string 34.

In use the inner string 34 is filled with a water cushion 39 between the cement phase 36 and the drilling mud 40.

In a yet alternative application of the invention, the inflating fluid could be delivered down hole in conjunction with the liner. This would be particularly appropriate when inflatable packers are to be employed on the outside of the liner, such as between the liner and the well bore.

The invention therefore negates the requirement of pumping cement or some other settable fluid or composition to a remote but relatively precise location to enable inflation of one or more packers. Indeed, the invention provides an improved method for transporting the settable fluid to the packers with a greatly enhanced reliability and integrity. Moreover, the invention herein envisages that the cement or other settable fluid can be transported from the surface of the well to the location where it is to be used in a compartment formed within or in association with an inner string or work string, liner or the like.

Further modifications and improvements may be incorporated without departing from the scope of the invention herein intended.

What is claimed is:

1. A method for inflating one or more packers in a well bore or down hole environment, the method comprising:

filling a compartment in or associated with a well bore string with a settable fluid at or near the surface of the well;

transporting the settable fluid down the well bore or down hole in conjunction with the well bore string; and aligning an outlet in the string with an inlet in at least one of said one or more inflatable packers within the well bore;

injecting the settable fluid into at least one of said one or more inflatable packers.

2. A method as claimed in claim 1 wherein the settable fluid comprises cement.

3. The method as claimed in claim 2 further comprising an initial step of preparing the cement under controlled conditions on-shore, the cement being been mixed with an additive or catalyst prior to use, wherein the additive or catalyst is adapted to cause the setting of the cement at a known or predetermined rate.

4. The method as claimed in claim 1 wherein the settable fluid comprises resin.

5. The method as claimed in claim 1 wherein the well bore string is an inner string located within an external liner or conduit suspended from a drill pipe or liner.

6. The method as claimed in claim 1 wherein the well bore string comprises a liner.

7. The method as claimed in claim 1, further comprising circulating well bore fluid past the settable fluid while the string is run and the one or more packers are set.

8. The method as claimed in claim 1, further comprising picking up the string to align the outlet in the string with the inlet in at least one of said one or more inflatable packers to allow the settable fluid to be injected into the at least one packer.

9. The method as claimed in claim 1 in which integrity of the settable fluid is maintained by activating or engaging seals above and below said one or more packers be set, prior to injecting the settable fluid into the one or more packers.

10. The method as claimed in claim 1 in which the integrity of the settable fluid is maintained by opening a valve means associated with an outlet for the settable fluid on the string only when the outlet is aligned with an inlet for receiving the settable fluid on the one or more packers.

11. The method as claimed in claim 1 in which the integrity of the settable fluid is maintained by further including the step of inflating a sacrificial or secondary packer prior to injecting the settable fluid into said one or more inflatable packers, wherein said one or more inflatable packers is a primary or permanent packer.

12. The method as claimed in claim 1 further comprising inflating a first packer at a first setting pressure, and subsequently inflating one or more additional packers at one or more alternative setting pressures.

13. The method as claimed in claim 12 wherein each of the one or more subsequent alternative setting pressures are successively higher than a previous setting pressure.

14. The method as claimed in claim 1 further comprising:

locating dedicated inflation tools on the string prior to running the string, wherein the tools are separated by a distance corresponding to a distance separating a plurality of inflatable packers to be set;

subsequently running the string, thereby transporting the inflation tools to the vicinity of each of the packers;

aligning the inflation tools with each of the packers; and thereafter injecting fluid into each of the packers simultaneously.

15. The method as claimed in claim 1 wherein the one or more inflated packers provide an annular seal or barrier in a liner.

16. A method as claimed in claim 1 wherein the one or more inflated packers provide means for hanging or packing a liner.

17. The apparatus according to claim 1, wherein the transporting step comprises moving said compartment relative to one or more packers that were previously set in position.

18. An apparatus for use in a well bore comprising:

a well bore string and settable fluid for inflating one or more inflatable packers in a well, characterized in that the string is provided with means for supporting the settable fluid while being run in the well bore, wherein the string is associated with locating means adapted to locate the string at an appropriate position for the inflation of one or more of the respective packers.

19. The apparatus as claimed in claim 18 wherein the string is an inner string located within and external liner or conduit.

20. The apparatus as claimed in claim 18 further comprising a plug located at a lower end of the string to prevent the settable fluid from escaping out of the bottom of the string.

21. The apparatus as claimed in claim 20 further comprising bypass means to enable circulation of a well bore fluid through the string, wherein the well bore fluid is able to bypass the settable fluid and the plug.

22. The apparatus as claimed in claim 18 further comprising a barrier provided in the string above the settable fluid to prevent or mitigate the influx of mud or other contaminants into the settable fluid.

23. The apparatus as claimed in claim 18 wherein the string is one of dual strings running parallel in the well, wherein the other of the dual strings is a circulation string.

24. The apparatus as claimed in claim 18, wherein the string supports a plurality of inflation tools inflating a plurality of inflatable packers on a liner or conduit, and wherein the inflation tools are spaced on the string by distances which correspond to the spacing between the plurality of inflatable packers.

25. The apparatus as claimed in claim 18 comprising a plurality of discreet portions of settable fluid located in the string, wherein each discreet portion of settable fluid is located between a check valve and a respective barrier and is intended for the inflation of a respective packer.

26. The apparatus as claimed in claim 18 wherein the string is provided with a water cushion between a phase of drilling mud and a phase of settable fluid.

27. The apparatus as claimed in claim 18 wherein the settable fluid comprises resin.

28. The apparatus as claimed in claim 18 wherein the settable fluid comprises cement.

* * * * *